US006877255B2

(12) United States Patent
O'Hare

(10) Patent No.: US 6,877,255 B2
(45) Date of Patent: Apr. 12, 2005

(54) TWO-IN-ONE SHOE COMPONENT

(75) Inventor: Kieran O'Hare, Workington (GB)

(73) Assignee: E. I. du Pont de Nemours and Company, Wilmington, DE (US)

( * ) Notice: Subject to any disclaimer, the term of this patent is extended or adjusted under 35 U.S.C. 154(b) by 264 days.

(21) Appl. No.: 09/681,973

(22) Filed: Jul. 2, 2001

(65) Prior Publication Data

US 2002/0004345 A1 Jan. 10, 2002

Related U.S. Application Data

(60) Provisional application No. 60/216,098, filed on Jul. 6, 2000.

(51) Int. Cl.[7] ..... A43B 24/00

(52) U.S. Cl. ..... 36/45; 36/1; 36/55; 36/10; 36/71; 36/93; 428/101; 428/102; 428/103; 428/195; 428/196; 428/198; 428/304.4; 442/63; 442/76; 442/168; 442/360; 442/364; 442/374; 442/394

(58) Field of Search ..... 36/1, 45, 10.55, 36/71, 93; 428/101, 102, 103, 195, 196, 198, 215; 442/63, 76, 168, 360, 364, 374, 394, 102, 164, 396

(56) References Cited

U.S. PATENT DOCUMENTS

| | | | | | |
|---|---|---|---|---|---|
| 3,663,266 | A | | 5/1972 | Dye | 442/77 |
| 4,229,472 | A | * | 10/1980 | Suskind et al. | 428/113 |
| 5,035,943 | A | | 7/1991 | Kinlaw et al. | 442/79 |
| 5,134,017 | A | * | 7/1992 | Baldwin et al. | 428/198 |
| 5,714,256 | A | | 2/1998 | DeLucia et al. | 428/373 |

FOREIGN PATENT DOCUMENTS

| | | | |
|---|---|---|---|
| DE | 1419149 | A | 12/1968 |
| EP | 0357185 | A2 | 3/1990 |
| GB | 1130576 | A | 10/1968 |
| GB | 2074091 | A | 10/1981 |

* cited by examiner

*Primary Examiner*—Arti R. Singh

(57) ABSTRACT

A laminate of a thermally pointbonded nonwoven base fabric and a coating of polyurethane or polyvinyl chloride on at least one surface of the base fabric, and a footwear upper made from the laminate and wherein the upper functions additionally as a lining for the footwear.

2 Claims, No Drawings

TWO-IN-ONE SHOE COMPONENT

BACKGROUND OF INVENTION

This invention is directed to the use of coated nonwoven fabrics as shoe components.

Various types of materials are used for footwear components. Leather is probably the oldest and best-known material for use in footwear. Leather is known to be used for both linings and for uppers. Artificial leathers and other man-made materials are also used to make uppers, especially in low-end shoes. In fact, such footwear is typically made without a lining, but they are not as comfortable as lined shoes. As understood in the footwear field, upper is the part of a shoe or boot that is above the sole and encloses the foot of the wearer either totally or partially. It is understood that hereafter the term shoe will at times to refer to footwear, generally.

Polyurethane-coated fabrics (PUCFs) are used for making shoes and account for about one-half of the uppers used in women's shoes. They account for a lower, but significant, proportion of men's and children's shoes. Shoes made from PUCFs usually have a separate lining. PUCFs fall into two main categories Transfer PUCFs and Coagulated PUCFs. Transfer PUCFs are generally considered as conventional PUCFs because they were introduced first. The process used to make them is sometimes call the dry process. Coagulated types are made using a wet process and this is particularly true of dip-coagulation. Transfer coated fabrics usually comprise a woven fabric base of either cotton or a polyester/cotton blend, and a top skin of PU attached by means of an adhesive.

The coating is normally a polymer film of about 0.025 0.05 mm thickness and the woven fabric base is a 4×1 twill structure. The PU top skin serves two functions to make the fabric look attractive and to protect it from the rigors of wear. Coagulated PUCFs were developed in response to the need for upper materials having breathable properties yet at a competitive price. They offer a number of benefits over transfer coated PUCFs, such as, better hand, attractive appearance and non-fray characteristics.

There are two types of coagulated PUCFs; dip-coagulated and top-coagulated. The dip-coagulated method is the most widely used in Europe and North America, while the top-coagulated type is most widely used in Asia and the Pacific Rim. The main feature of a dip-coagulated PUCF is that the base fabric is completely immersed in a viscous PU solution that both penetrates and coats the weave of the base fabric.

Although PUCFs are currently more popular, the first coated fabrics on the market were the polyvinyl chloride (PVC) coated types. The structure of the material consists of woven, knitted or non-woven base fabrics coated with a layer of plasticized PVC, which can have either a solid or a cellular form.

Although woven base fabrics have typically been used for PUCFs, non-woven fabrics are being used increasingly, especially in dip-coagulated PUCFs. The advantages of non-wovens include higher levels of strength and tear resistance and more uniform properties in both the warp and weft directions, which correspond to the machine and cross machine directions, respectively, in a nonwoven fabric.

DETAILED DESCRIPTION

Thermally point bonded nonwoven fabrics have been widely used for linings in shoes. However, it has now been found that there are advantages to using thermally point-bonded nonwoven materials coated with polyurethane or polyvinyl chloride to form a laminate for broader applications in footwear. The term laminate herein refers to a sheet-like structure wherein a polymer is coated or otherwise applied to the surface of a fabric. However, it has surprisingly been found that by coating a base fabric as disclosed herein, the resulting material can be used in a dual purpose role as both an upper and as a lining.

Cambrelle®, available from E.I. du Pont de Nemours and Company, Wilmington, Del. is a particularly good candidate for the base fabric. Cambrelle® is formed from staple, bicomponent polyamide fibers that are processed into a web and thermally point-bonded. Typical fibers include nylon 6 staple fibers, nylon 66 staple fibers, nylon 6/nylon 66 sheath/core staple fibers, and blends thereof. Cambrelle® is already well known as having excellent properties for footwear linings, such as, water vapor permeability, quick drying, comfortable and durable. There are other properties that Cambrelle® possesses that also make it desirable as a base fabric in an upper, for example, strength, durability, dyeablity and the ability to maintain a clean edge when cut, among others.

The inventive fabric can be made by coating the nonwoven base fabric with materials such as polyurethane (PU) or polyvinyl chloride (PVC) and employing similar processes used for other coated fabrics. When materials such as Cambrelle® are used as a shoe lining, the upper has been formed from some other material. Significant savings in material and time can now be achieved by using the inventive fabric because one piece of material can be used to take the place of both an upper and a lining, i.e., acting as a two-in-one component.

The inventive fabric can be made by several different processes as was mentioned above and as further described below, specifically the transfer process and the coagulated process (both dip and top coagulation). PVC coated fabrics (PVCCFs) are also made by the transfer process.

Coagulated PUCFs There are two types of coagulated PUCFs; dip-coagulated and top-coagulated. The main feature of a dip-coagulated PUCF is that the base fabric is completely immersed in a viscous PU solution that both penetrates and coats the fabric.

The stages of the dip-coagulated PUCF production progress are described as follows. The fabric is dipped (or impregnated) in a series of tanks containing a solution of polyurethane in a solvent, usually dimethylformamide (DMF). Following immersion in the first tank, nip rollers are normally used to remove the excess PU before the fabric is dipped in a second tank. A knife or doctor-blade is then used to control the final amount of PU applied. The coating solution commonly used has a low viscosity and normally contains less than 15 percent PU this might be varied slightly depending on the final coating weight requirements. Unless noted otherwise, percentages or parts are by weight throughout the application. The impregnated fabric is passed through a series of tanks containing solvent/water mixture decreasing in solvent concentration until the final tank which consists of only water.

At this stage, the coagulated fabric is heated to remove any remaining solvent and passed through rollers before final washing, drying and rolling up. Finishing is normally carried out via a transfer coating process in which the coagulated base cloth simply replaces the raised woven fabric. Alternatively the PU top skin can be applied by spraying, by embossing, or by a combination of these methods.

With top-coagulated PUCFs, the PU solution is applied on one side of the fabric only (by doctor-blade) but then coagulated and finished as for dip coagulated materials. As such, with the top-coagulated materials the base fabric is visible on one side of the material. It should be noted that although the dip coagulation method can coat both sides of the nonwoven fabric, it is preferable to coat only one side for that process as well.

Transfer Coated Fabrics The polyurethane is usually obtained as a solution of 25–40 percent polymer in a solvent, commonly a mixture of one part dimethylformamide (DMF) and two parts methylethylketone (MEK). The PU comprises two components, a pre-polymer and a functional isocyanate, which chemically react to form a tough cross-linked elastomeric polymer of molecular weight about 30,000 40,000.

The prepared PU solution is coated onto release paper, which provides the grain or surface effects for the coated fabric. In the transfer coating process the roll of release paper is unwound into a first coating head and passed under a coating knife. The viscosity of the PU solution is kept sufficiently high to allow it to be poured onto the supported release paper, just in front of the knife. Because of the motion of the release paper past the knife, the coating mixture builds up against the knife and settles onto the release paper underneath.

The coated transfer paper is next taken through the drying oven while blowers force the heated air over the coated paper moving underneath. At entry, the temperature is usually in the region of 60–80° C., rising to 120–160° C. at the exit. This temperature range ensures that virtually all the solvents that were used are boiled off.

Fabric is taken from a roll above the coating line and pressed onto the adhesive coated PU top film using a series of automatic rollers. The coated fabric laminate is passed through a second drying oven to remove the adhesive solvents and consolidate the bond. Ovens are usually set at a temperature not exceeding 150° C. in most transfer coating processes.

After leaving the second oven fully dried, the coated fabric is cooled over steel rollers. When it is at the right temperature, the release paper is separated from the PUCF and re-wound.

A back-coated PUCF is essentially a conventional transfer-coated material, which has been treated on the reverse side with a coating of polyurethane or acrylic resin. This coating is thin (approximately 0.05 mm) and does not penetrate the fabric, but simply provides the look of a coagulated PUCF.

Polyvinyl Coated FabricsA typical PVC formulation includes PVC polymer, a plasticizer, a stabilizer, a moisture-absorbing agent, a pigment and in the cellular PVC, a blowing agent. The plasticizers used are normally phthalate-based, for example dioctyl phthalate or blends of different phthalates. Once the compound has been prepared, the PVC coated fabric can be fabricated. The route to this is essentially the same transfer coating process described with PUCFs. First, the top coat is applied to a release paper using a doctor-blade and then gelled at 150° C.

The next step is to apply the middle (normally expanded) layer onto the coated release paper. This is usually carried out at about 150° C. causing the layer to gelbut not blown because the temperature is too low. Normally this layer is thicker than the skin layer.

The third step is to apply a tie coat to the expanded layer before laminating the base fabric. The tie coat often consists of expanded PVC material. While the tie coat is still wet, the fabric is pressed on to it using nip rollers and then taken through to the final oven.

The PVC structure is attained in this final oven by blowing and curing the material. The entrance of the oven is normally set at 150° C. to get the adhesive layer. The expanded layer is then blown in the center of the oven at 180–200° C. The process is completed at 200–220° C. at the far end of the oven.

What is claimed is:

1. A footwear upper comprising a thermally pointbonded nonwoven base fabric coated with polyurethane on at least one surface of the base fabric and wherein the polyurethane is impregnated throughout the interior of the fabric by dip coagulation, and wherein the upper functions additionally as a lining.

2. The footwear upper of claim 1, wherein the base fabric comprise fibers selected from the group consisting of nylon 6 staple fibers, nylon 66 staple fibers, nylon 6/nylon 66 sheath/core staple fibers, and blends thereof.

* * * * *